US005472397A

United States Patent [19]

Ammoscato et al.

[11] Patent Number: 5,472,397

[45] Date of Patent: Dec. 5, 1995

[54] RETRACTABLE DUMBBELL SUPPORT BENCH

[76] Inventors: Vincenzo Ammoscato, 917 Gladstone, Windsor, Ontario, Canada, N9A 2R5; Kevin A. Dewolf, 3170 Woodstone La., #132, Novi, Mich. 48377

[21] Appl. No.: 278,099

[22] Filed: Jul. 21, 1994

[51] Int. Cl.[6] ..... A63B 21/078

[52] U.S. Cl. ..... 482/104

[58] Field of Search ..... 482/97, 100, 104

[56] References Cited

U.S. PATENT DOCUMENTS 4,838,547 6/1989 Sterling ..... 482/104 X 5,281,193 1/1994 Colbo, Jr. ..... 482/104

*Primary Examiner*—Richard J. Apley

*Assistant Examiner*—John Mulcahy

[57] ABSTRACT

An exercise bench for movably supporting a pair of dumbbells on opposed sides of the bench within reach of a user. The inventive device includes a main frame having a seat supported thereby with a backrest pivotally mounted to the seat. A center stanchion extends from the backrest to the main frame and can be adjusted so as to position the backrest at a desired angle. A pair of dumbbell supports are pivotally mounted to the center stanchion and are each operable to movably support a dumbbell thereon. A foot actuator connected to the dumbbell supports by a cable is operable both to pivot the dumbbell supports into reach prior to commencing of an exercise procedure, and to pivot the supports out of the way during the exercise procedure.

15 Claims, 4 Drawing Sheets

RETRACTABLE DUMBBELL SUPPORT BENCH

BACKGROUND OF THE INVENTION

1. Field of the Invention

The present invention relates to exercise bench structures and more particularly pertains to a retractable dumbbell support bench for movably supporting a pair of dumbbells on opposed sides of the bench within reach of a user.

2. Description of the Prior Art

The use of exercise bench structures is known in the prior art. More specifically, exercise bench structures heretofore devised and utilized for the purpose of supporting exercise weights proximal to a user are known to consist basically of familiar, expected and obvious structural configurations, notwithstanding the myriad of designs encompassed by the crowded prior art which have been developed for the fulfillment of countless objectives and requirements.

For example, a dumbbell position rack is illustrated in U.S. Pat. No. 4,666,150 which includes a saddle mountable on telescoping tubular members which will support a complete dumbbell thereon. The saddle includes an open area centrally located therethrough to allow a hand to pass through on the return of the dumbbell to the saddle. A guide positioned on the saddle above the open area directs the plates or assembled weight of a dumbbell away from the open area, thereby positioning the dumbbell into the resting area of the saddle.

Another patent of interest is U.S. Pat. No. 4,791,449 which teaches a weightlifting safety device having a bar and weight support assemblies depending vertically for support on a support surface at a predetermined elevated position. The attachment of the elements of the safety device to a standard barbell permits relative rotation therebetween, and in one form of the invention includes a dampening means to limit such relative rotation. The support system is configured to be readily assembled onto and dissembled from a barbell.

Other known prior art exercise bench structures are disclosed in U.S. Pat. No. 4,955,604; U.S. Pat. No. 4,477,074; U.S. Pat. No. 4,471,956; and U.S. Pat. No. 4,406,452.

While these devices fulfill their respective, particular objectives and requirements, the aforementioned patents do not disclose a retractable dumbbell support bench for movably supporting a pair of dumbbells on opposed sides of the bench within reach of a user which includes a main frame having a seat supported thereby with a backrest pivotally mounted to the seat, a center stanchion extending from the backrest to the main frame which may be adjusted so as to position the backrest at a desired angle, a pair of dumbbell supports pivotally mounted to the center stanchion and each operable to movably support a dumbbell thereon, and a foot actuator connected to the dumbbell supports by a cable, whereby the foot actuator is operable both to pivot the dumbbell supports into reach of a user prior to commencing of an exercise procedure, and to pivot the supports out of the way during the exercise procedure.

In these respects, the retractable dumbbell support bench according to the present invention substantially departs from the conventional concepts and designs of the prior art, and in so doing provides an apparatus primarily developed for the purpose of movably supporting a pair of dumbbells on opposed sides of the bench within a reach of a user.

SUMMARY OF THE INVENTION

In view of the foregoing disadvantages inherent in the known types of exercise bench structures now present in the prior art, the present invention provides a new retractable dumbbell support bench construction wherein the same can be utilized for movably supporting a pair of dumbbells on opposed sides of the bench within a reach of a user. As such, the general purpose of the present invention, which will be described subsequently in greater detail, is to provide a new retractable dumbbell support bench apparatus and method which has many of the advantages of the exercise bench structures mentioned heretofore and many novel features that result in a retractable dumbbell support bench which is not anticipated, rendered obvious, suggested, or even implied by any of the prior art exercise bench structures, either alone or in any combination thereof.

To attain this, the present invention generally comprises an exercise bench for movably supporting a pair of dumbbells on opposed sides of the bench within reach of a user. The inventive device includes a main frame having a seat supported thereby with a backrest pivotally mounted to the seat. A center stanchion extends from the backrest to the main frame and can be adjusted so as to position the backrest at a desired angle. A pair of dumbbell supports are pivotally mounted to the center stanchion and are each operable to movably support a dumbbell thereon. A foot actuator connected to the dumbbell supports by a cable is operable both to pivot the dumbbell supports into reach prior to commencing of an exercise procedure, and to pivot the supports out of the way during the exercise procedure.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retractable dumbbell support bench apparatus and method which has many of the advantages of the exercise bench structures mentioned heretofore and many novel features that result in a retractable dumbbell support bench which is not anticipated, rendered obvious, suggested, or even implied by any of the prior art exercise bench structures, either alone or in any combination thereof.

It is another object of the present invention to provide a new retractable dumbbell support bench which may be easily and efficiently manufactured and marketed.

It is a further object of the present invention to provide a new retractable dumbbell support bench which is of a durable and reliable construction.

An even further object of the present invention is to provide a new retractable dumbbell support bench which is susceptible of a low cost of manufacture with regard to both materials and labor, and which accordingly is then susceptible of low prices of sale to the consuming public, thereby making such retractable dumbbell support benches economically available to the buying public.

Still yet another object of the present invention is to provide a new retractable dumbbell support bench which provides in the apparatuses and methods of the prior art some of the advantages thereof, while simultaneously overcoming some of the disadvantages normally associated therewith.

Still another object of the present invention is to provide a new retractable dumbbell support bench for movably supporting a pair of dumbbells on opposed sides of the bench within a reach of a user.

Yet another object of the present invention is to provide a new retractable dumbbell support bench which includes a main frame having a seat supported thereby with a backrest pivotally mounted to the seat, a center stanchion extending from the backrest to the main frame which may be adjusted so as to position the backrest at a desired angle, a pair of dumbbell supports pivotally mounted to the center stanchion and each operable to movably support a dumbbell thereon, and a foot actuator connected to the dumbbell supports by a cable, whereby the foot actuator is operable both to pivot the dumbbell supports into reach of a user prior to commencing of an exercise procedure, and to pivot the supports out of the way during the exercise procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
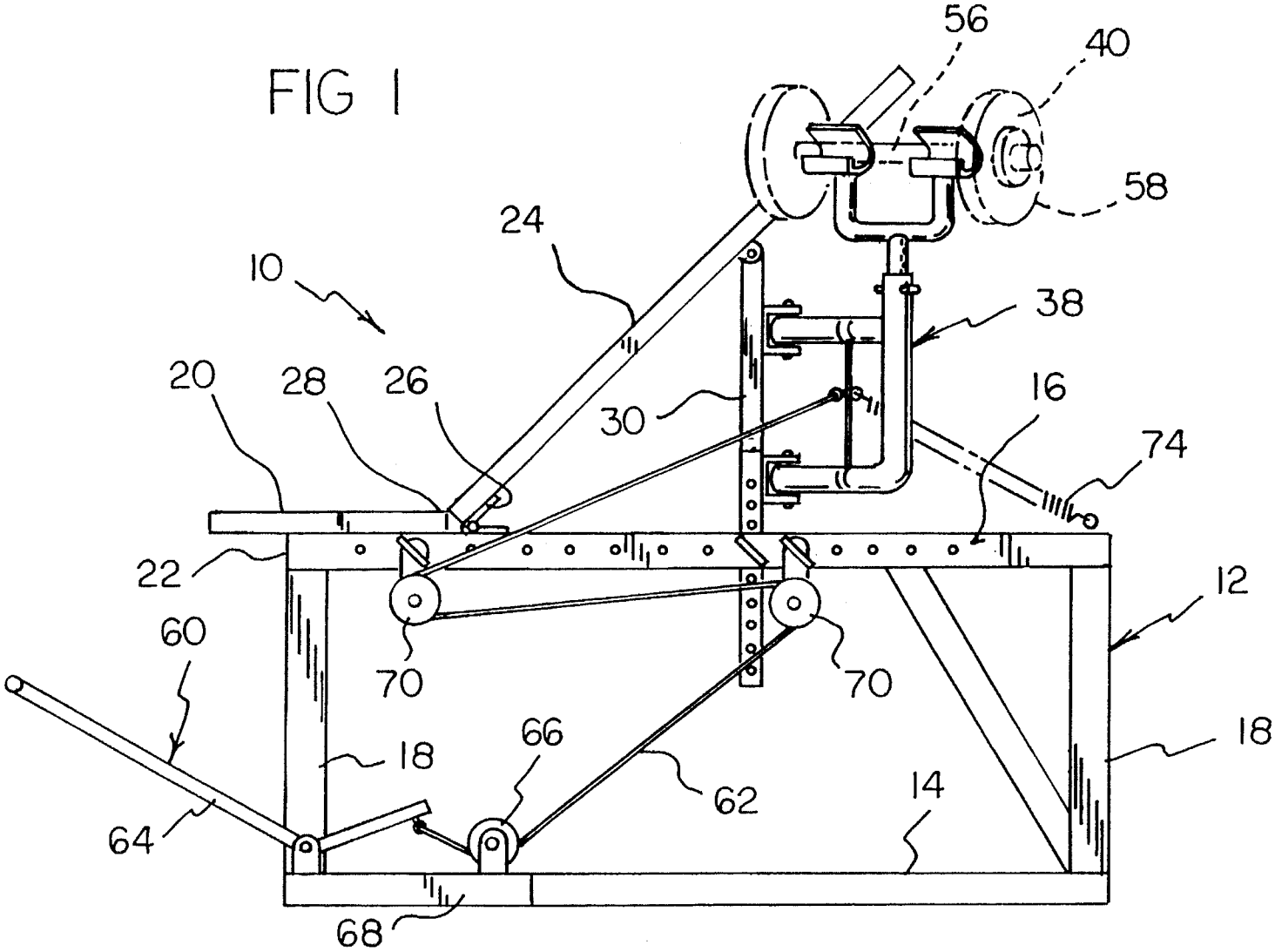
FIG. 1 is a side elevation view of a retractable dumbbell support bench according to the present invention.

With reference now to the drawings, and in particular to FIGS. 1–5 thereof, a new retractable dumbbell support bench embodying the principles and concepts of the present invention and generally designated by the reference numeral 10 will be described.

Figure 5:
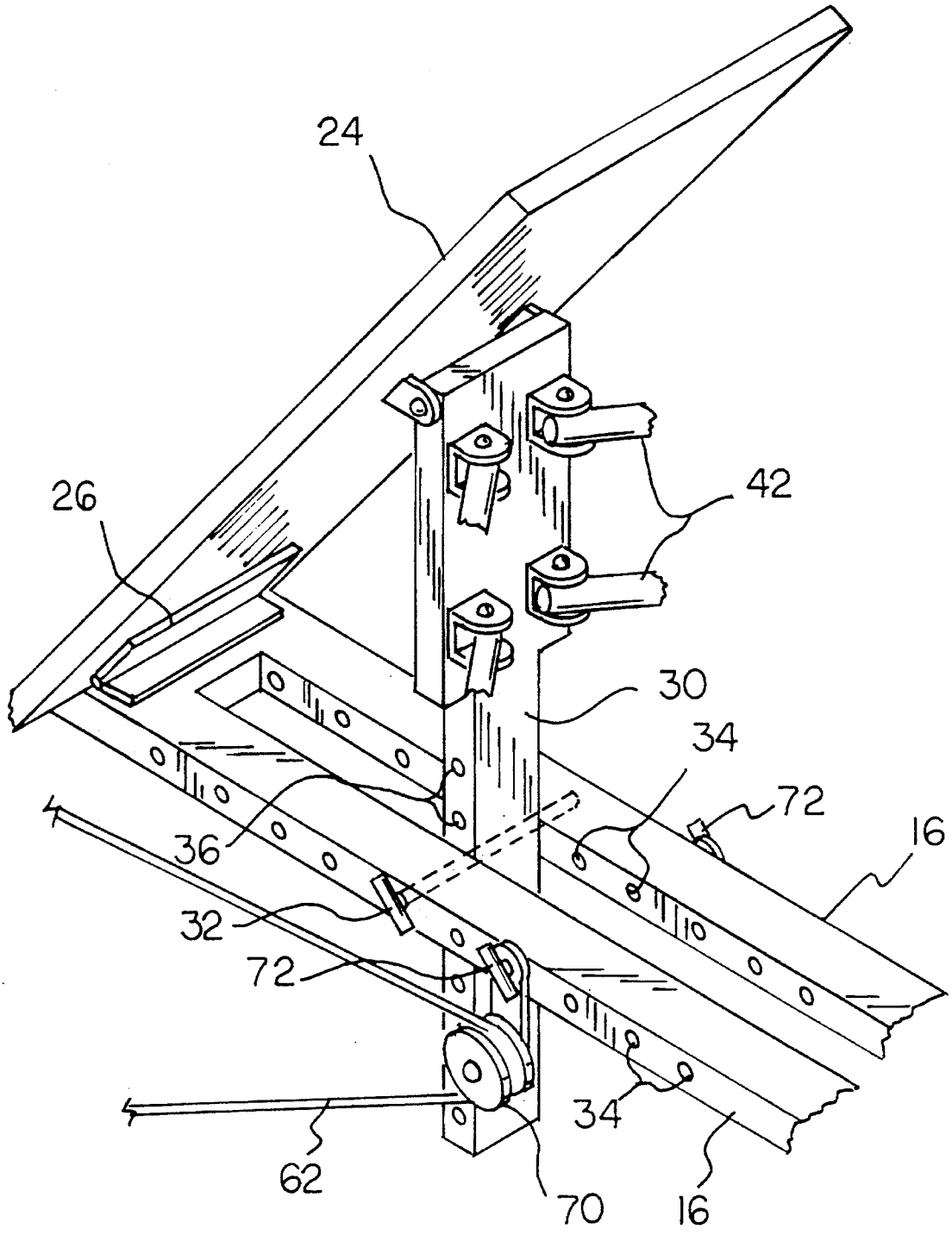
FIG. 5 is an enlarged isometric view of a further portion of the present invention.

More specifically, it will be noted that the retractable dumbbell support bench 10 comprises a main frame 12 having at least one lower member 14 and at least one upper member 16 supported in a substantially spaced, parallel relationship by a pair of upright members 18. Preferably, the main frame 12 includes a pair of upright members 16, as illustrated in FIG. 5 for example. A seat 20 is mounted across the upright member 16 at a forward end 22 of the upright members 16. A backrest 24 is pivotally mounted by a hinge 26 to the upper member 16 proximal a rear edge 28 of the seat 20, as best illustrated in FIG. 1. A center stanchion 30 is pivotally mounted to the backrest 24 and extends substantially downwardly to project between the upper members 16 of the main frame 12, as best illustrated in FIG. 5. To secure the center stanchion 30 to the upper members 16 a center stanchion pin 32 can be positioned through any of a plurality of apertures 34 in the upper members 16 and through any of a plurality of apertures 36 in the center stanchion 30. By this structure, the center stanchion 30 may be secured in a desired position along a longitudinal length of the upper member 16 so as to position the backrest 24 into any of a plurality of desired angles relative to the seat 20. Thus, the backrest 24 may be positioned in an upright orientation by securing the center stanchion 30 to the upper member 16 in a forwardmost orientation, or alternatively, in an inclined position by securing the center stanchion to the upper members in a rearwardmost position.

Figure 3:
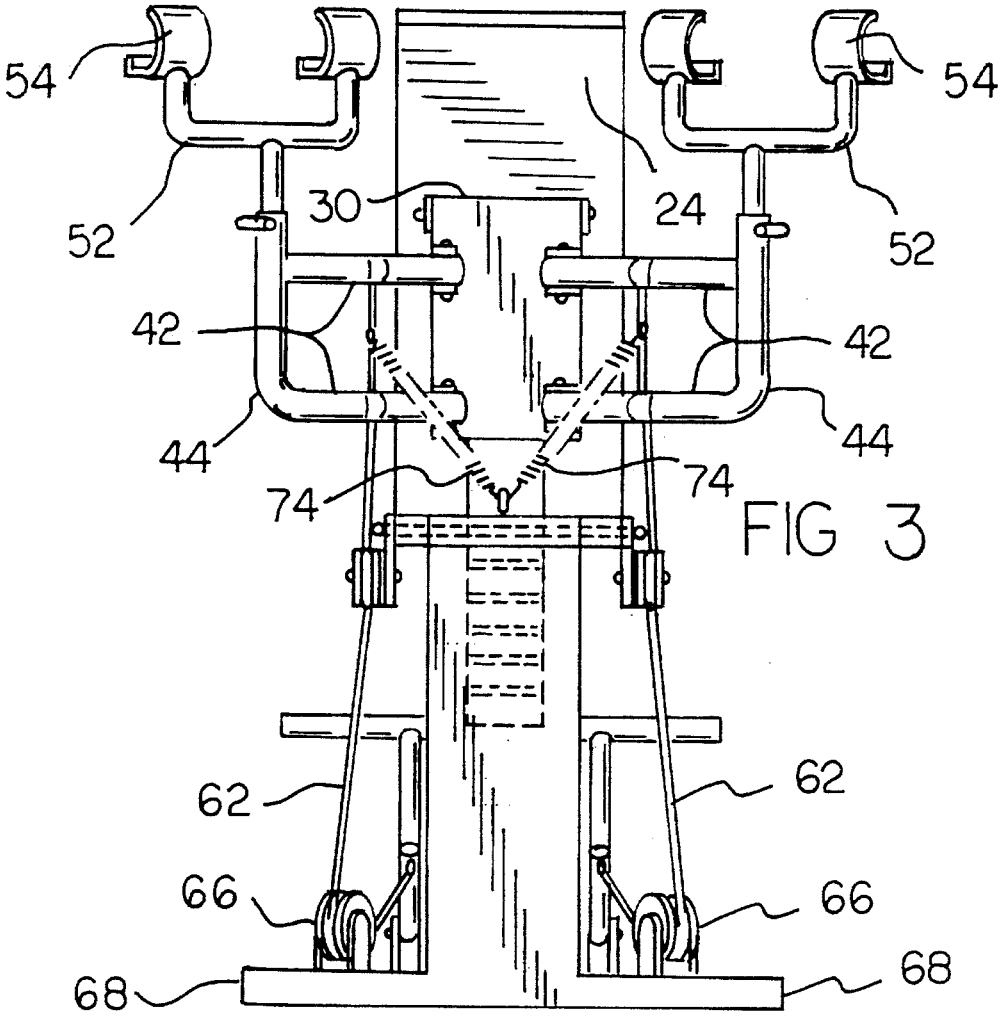
FIG. 3 is a rear elevation view of the present invention.
Figure 4:
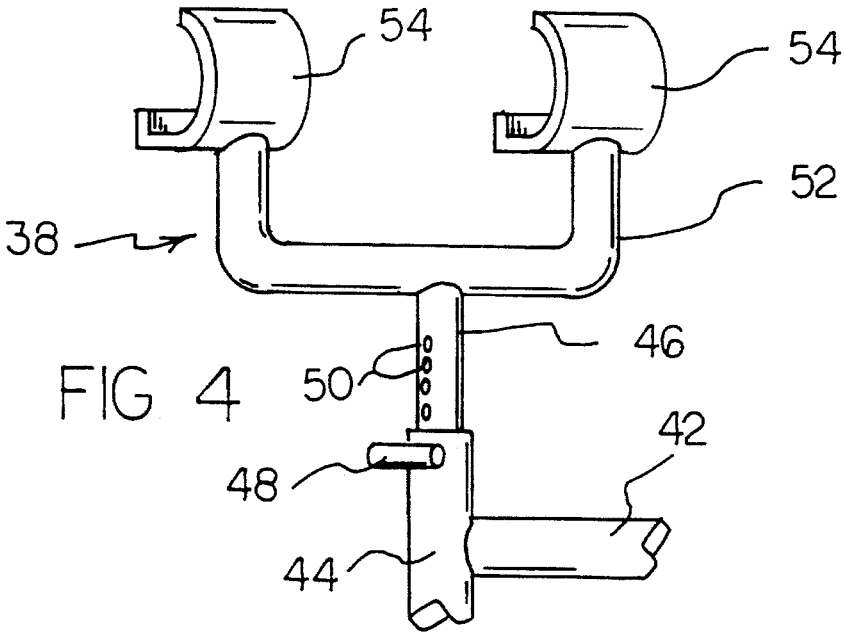
FIG. 4 is an enlarged isometric illustration of a portion of the invention.

A pair of dumbbell support assemblies 38 are pivotally mounted to the center stanchion 30 and are each operable to retain and support a dumbbell 40, as illustrated in FIG. 1. To this end, each of the dumbbell supports 38 is substantially similar in construction and includes a pair of arms 42 pivotally mounted to the center stanchion by a plurality of unlabelled hinges, as best illustrated in FIG. 3. The arms 42 extend substantially horizontally outward from the center stanchion and are integrally or otherwise fixedly secured at outer distal ends thereof to a receiving member 44 which extends orthogonally and vertically relative to the arms. A telescoping member 46 is movably positioned at least partially within the receiving member 44 and may be secured in a desired orientation relative to the receiving member by a pin 48 which extends through an aperture in the receiving member and any one of a plurality of apertures 50 within the telescoping member. A U-shaped support 52 is secured to the telescoping member 46 and includes a pair of dumbbell engaging cups 54 secured to upper distal ends of the U-shaped support. The dumbbell engaging cups 54 may be dimensioned so as to engage the bar 56 of the dumbbell 40, as illustrated in FIG. 1, or alternatively, the dumbbell engaging cups may be configured so as to receive the weight portions 58 of a dumbbell 40. Regardless of the size or configuration of the dumbbell engaging cups 54, the U-shaped support 52 permits a user to grasp a center of the bar 56 of the dumbbell 40 to lift the dumbbell from the dumbbell support assembly 38.

Figure 2:
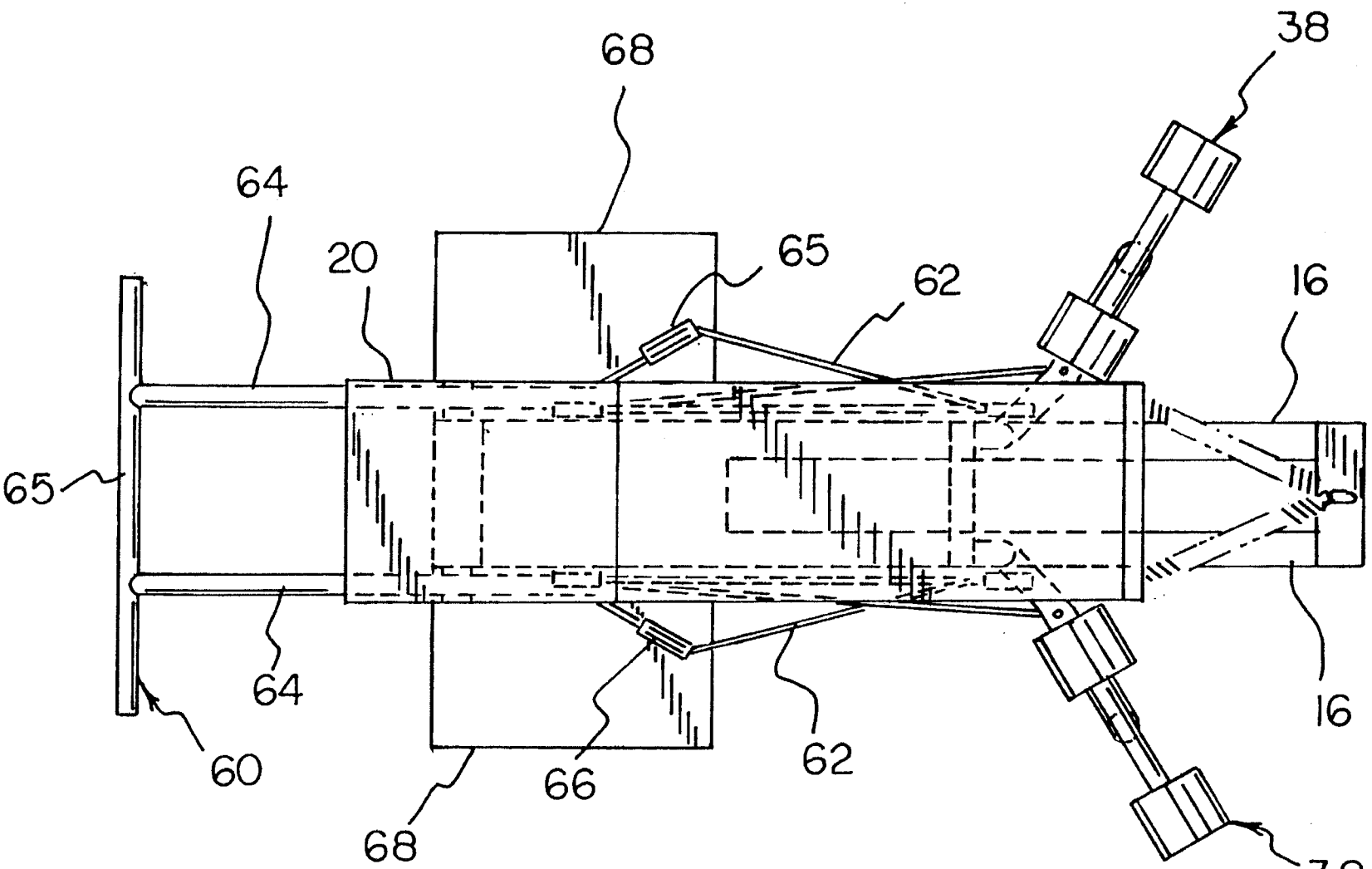
FIG. 2 is a top plan view of the invention.

Because of the pivotal mounting of the dumbbell support assemblies 38 to the center stanchion 30, a pair of dumbbells 40 may be moved within reach of a user residing on the seat 20 and leaning against the backrest 24, whereby the user may grasp the dumbbells to perform an exercise, with the dumbbell supports 38 being movable out of the way during such exercise. To effect remote actuation or movement of the dumbbells support assemblies 38 by the user, a foot actuator 60 is pivotally mounted to the lower member 14 and mechanically coupled to the dumbbell support assemblies by at least one cable 62. As best illustrated in FIG. 2, the foot actuator 60 comprises a pair of levers 64 having a cross bar 65 extending therebetween at outer distal ends of the levers. The levers 64 are pivotally mounted to the main frame 12 by at least one unlabelled hinge, with the cables 62 each being coupled to an inner end of the individual levers. The cables 62 each extend over an individual one of a pair of guide pulleys 66 which are mounted to the main frame 12, and preferably mounted to a pair of lateral members 68 which project from the lower members 14 and cooperate to further stabilize the main frame 12. The cables 62 further traverse over a pair of adjustment pulleys 70 which are movably positioned along the upper members 16 and secured thereto by adjustment pulley pins 72 which extend through any of the apertures 34 in the upper members. Thus, the adjustment pulleys 70 can be positioned so as to remove slack from the cables 62 resulting from a movement of the backrest 24. To provide a return force tending to pivot the dumbbell support assemblies 38 together behind the backrest 24, at least one spring 74 is provided. The spring 74 may extend between the dumbbell support assemblies 38, or alternatively, a pair of such springs 74 may extend from the dumbbell assemblies 38 to a portion of the main frame 12, as illustrated in FIG. 3.

In use, the retractable dumbbell support bench 10 is operable to retain a pair of dumbbells 40 within the dumbbell support assemblies 34, whereby a user may depress the foot actuator 60 to pivot the dumbbell support assemblies to opposed lateral sides of the backrest 24. The dumbbells 40 may then each be grasped by the user and lifted from the associated dumbbell support assembly 38. The dumbbell support assemblies 38 may then be pivoted out of the way by a releasing of the foot actuator 60 which permits the spring 74 to retract the dumbbell support assemblies. Commencing of an exercise procedure with the dumbbells 40 may then begin, whereafter the dumbbell support assemblies 38 may be pivoted forwardly by an actuation of the foot actuator 60 and the dumbbells placed back upon the support assemblies. The retractable dumbbell support bench 10 greatly increases safety during the exercise procedure and permits an individual to perform various dumbbell exercises without the need for a workout partner, spotter, or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new retractable dumbbell support bench comprising:

a main frame;

a seat mounted to said main frame;

a backrest pivotally mounted to said main frame;

a center stanchion pivotally mounted to said backrest and adjustably secured to said main frame for adjusting the incline of said backrest;

a first dumbbell support assembly means for supporting a first dumbbell pivotally mounted to said center stanchion;

a second dumbbell support assembly means for supporting a second dumbbell pivotally mounted to said center stanchion; and, foot actuator means mechanically coupled to said dumbbell support assembly means for selectively pivoting said dumbbell support assembly means about said center stanchion.

2. The new retractable dumbbell support bench of claim 1, wherein said foot actuator means comprises a pair of levers having a cross bar extending between said levers at outer distal ends of the levers, with the levers being pivotally mounted to said main frame, and a pair of cables each coupled to an inner end of an individual one of said levers, said cables further being coupled to said dumbbell support assembly means such that a pivoting of said levers causes said dumbbell support assembly means to pivot in a first direction.

3. The new retractable dumbbell support bench of claim 2, wherein said foot actuator means further comprises at least one spring coupled to said dumbbell support assembly means for biasing said dumbbell support assembly means in a second direction.

4. The new retractable dumbbell support bench of claim 3, wherein said foot actuator means further comprises at least one pulley coupled to said main frame for guiding at least one of said cables.

5. The new retractable dumbbell support bench of claim 4, wherein each of said dumbbell support assembly means comprises a pair of arms pivotally mounted to said center stanchion, a receiving member fixedly secured to outer distal ends of said arms, a telescoping member movably positioned at least partially within said receiving member, a substantially U-shaped support secured to an upper end of said telescoping member, and a pair of dumbbell engaging cups, each of said dumbbell engaging cups being secured to an individual upper distal end of said U-shaped support.

6. The new retractable dumbbell support bench of claim 5, wherein said dumbbell engaging cups are operable to engage a bar of either of the first and second dumbbells.

7. The new retractable dumbbell support bench of claim 5, wherein said dumbbell engaging cups are operable to engage a weight of either of the first and second dumbbells.

8. A new retractable dumbbell support bench comprising:

a main frame;

a seat mounted to said main frame;

a backrest pivotally mounted to said main frame;

a center stanchion pivotally mounted to said backrest and adjustably secured to said main frame for adjusting the incline of said backrest;

a first dumbbell support assembly means for supporting a first dumbbell pivotally mounted to said center stanchion;

a second dumbbell support assembly means for supporting a second dumbbell pivotally mounted to said center stanchion, each of said dumbbell support assembly means comprising at least one arm pivotally mounted to said center stanchion, a receiving member fixedly secured to an outer distal end of said arm, a telescoping member movably positioned at least partially within said receiving member, a substantially U-shaped support secured to an upper end of said telescoping member, and a pair of dumbbell engaging cups, each of said dumbbell engaging cups being secured to an individual upper distal end of said U-shaped support; and, foot actuator means mechanically coupled to said dumbbell support assembly means for selectively pivoting said dumbbell support assembly means about said center stanchion, said foot actuator means comprising at least one lever pivotally mounted to said main frame, and at least one cable coupled to an inner end of said at least one lever, said cable further being coupled to at least one of said dumbbell support assembly means such that a pivoting of said lever causes said at least one dumbbell support assembly means to pivot in a first direction.

9. The new retractable dumbbell support bench of claim 8, wherein said foot actuator means further comprises at least one spring coupled to said dumbbell support assembly means for biasing said dumbbell support assembly means in a second direction.

10. The new retractable dumbbell support bench of claim 9, wherein said foot actuator means further comprises at least one pulley coupled to said main frame for guiding said at least one cable.

11. The new retractable dumbbell support bench of claim 10, wherein said dumbbell engaging cups are operable to engage a bar of either of said first and second dumbbells.

12. The new retractable dumbbell support bench of claim 10, wherein said dumbbell engaging cups are operable to engage a weight of either of the first and second dumbbells.

13. A new retractable dumbbell support bench comprising:

a main frame;

a seat mounted to said main frame;

a backrest pivotally mounted to said main frame;

a center stanchion pivotally mounted to said backrest and adjustably secured to said main frame for adjusting the incline of said backrest;

a first dumbbell support assembly means for supporting a first dumbbell pivotally mounted to said center stanchion;

a second dumbbell support assembly means for supporting a second dumbbell pivotally mounted to said center stanchion, each of said dumbbell support assembly means comprising a pair of arms pivotally mounted to said center stanchion, a receiving member fixedly secured to outer distal ends of said arms, a telescoping member movably positioned at least partially within said receiving member, a substantially U-shaped support secured to an upper end of said telescoping member, and a pair of dumbbell engaging cups, each of said dumbbell engaging cups being secured to an individual upper distal end of said U-shaped support; and, foot actuator means mechanically coupled to said dumbbell support assembly means for selectively pivoting said dumbbell support assembly means about said center stanchion, said foot actuator means comprising a pair of levers having a cross bar extending between said levers at outer distal ends of the levers, with the levers being pivotally mounted to said main frame, a pair of cables each coupled to an inner end of an individual one of said levers, said cables further being coupled to said dumbbell support assembly means such that a pivoting of said levers causes said dumbbell support assembly means to pivot in a first direction, at least one spring coupled to said dumbbell support assembly means for biasing said dumbbell support assembly means in a second direction, and a pair of guide pulleys coupled to said frame, and a pair of adjustment pulleys movably coupled to said main frame, with each of said cables extending over at least two of said pulleys.

14. The new retractable dumbbell support bench of claim 13, wherein said dumbbell engaging cups are operable to engage a bar of either of the first and second dumbbells.

15. The new retractable dumbbell support bench of claim 13, wherein said dumbbell engaging cups are operable to engage a weight of either of the first and second dumbbells.

* * * * *